US010195009B2

(12) United States Patent
Schmitt et al.

(10) Patent No.: US 10,195,009 B2
(45) Date of Patent: Feb. 5, 2019

(54) SYSTEM FOR COLLECTING ANIMAL SEMEN AND METHOD FOR COLLECTING ANIMAL SEMEN USING SUCH A SYSTEM

(71) Applicant: IMV TECHNOLOGIES, Saint Ouen sur Iton (FR)

(72) Inventors: Eric Schmitt, Villaines-la-Juhel (FR); Agnès Camus, Sainte Gauburge Sainte Colombe (FR)

(73) Assignee: IMV TECHNOLOGIES, Saint Ouen sur Iton (FR)

( * ) Notice: Subject to any disclaimer, the term of this patent is extended or adjusted under 35 U.S.C. 154(b) by 814 days.

(21) Appl. No.: 14/661,216

(22) Filed: Mar. 18, 2015

(65) Prior Publication Data

US 2015/0265386 A1 Sep. 24, 2015

(30) Foreign Application Priority Data

Mar. 18, 2014 (FR) ..... 14 52237

(51) Int. Cl.
*A61D 19/02* (2006.01)

(52) U.S. Cl.
CPC ..... *A61D 19/021* (2013.01)

(58) Field of Classification Search
CPC combination set(s) only.
See application file for complete search history.

(56) References Cited

U.S. PATENT DOCUMENTS 3,401,696 A 9/1968 O'Brien
4,312,350 A * 1/1982 Doan ..... A61B 10/0058 604/349
4,744,352 A * 5/1988 Emery ..... A61D 19/021 604/349
D330,762 S * 11/1992 Anderson ..... D24/108
5,421,808 A * 6/1995 Osbon ..... A61F 5/41 600/38
5,466,235 A * 11/1995 Shubin, Sr. ..... A61H 19/00 600/38

(Continued)

FOREIGN PATENT DOCUMENTS

EP 2335597 A2 6/2011
GB 827895 A 2/1960
WO 0164936 A2 9/2001

*Primary Examiner* — Tatyana Zalukaeva
*Assistant Examiner* — Guy K Townsend
(74) *Attorney, Agent, or Firm* — Browdy and Neimark, P.L.L.C.

(57) ABSTRACT

The invention concerns a system for collecting animal semen, comprising a container (3) configured to be mounted on an end (9) of an artificial vagina (2), having an internal space (15) configured to receive said semen and configured to comprise a first dilution extender (5) before receiving said semen, and said system (1) comprises a collecting device (4) configured to be at least partially inserted into said container and to be fastened to said vagina, and being interposed between said vagina and said container, said collecting device comprising a flow channel (23) for said semen extending within said internal space of said container and a discharge aperture (26) for said semen open to said internal space; and said system is configured to prevent, at least for the most part, said first dilution extender from passing in said flow channel of said collecting device.

25 Claims, 4 Drawing Sheets

(56) References Cited

U.S. PATENT DOCUMENTS 5,782,818 A * 7/1998 Shubin ..... A61B 10/0058 600/38
5,806,523 A * 9/1998 Shubin, Sr. ..... A61F 6/04 128/842
5,807,360 A * 9/1998 Shubin ..... A61B 10/0058 128/897
6,149,580 A * 11/2000 Dabney ..... A61H 19/00 600/38
6,395,305 B1 * 5/2002 Buhr ..... A01N 1/02 424/450
6,554,811 B2 * 4/2003 Barth ..... A61D 19/021 128/830
7,186,212 B1 * 3/2007 McMullen ..... A63H 3/003 600/38
7,195,920 B2 * 3/2007 Seidel ..... A01K 67/027 209/571
7,217,239 B1 * 5/2007 Dyer ..... A61D 19/021 600/33
7,435,153 B1 * 10/2008 Sodec, Jr. ..... A47F 8/00 446/295
7,544,062 B1 * 6/2009 Hauschild ..... G09B 23/285 434/267
7,753,895 B2 * 7/2010 Matsuura ..... A61B 10/0045 128/842
7,947,026 B2 * 5/2011 Herr ..... A61B 10/0058 604/317
7,993,315 B2 * 8/2011 Matsuura ..... A61B 10/0058 600/38
8,475,422 B2 * 7/2013 Wu ..... A61B 10/0058 604/349
8,486,618 B2 * 7/2013 Schenk ..... A61D 19/00 422/73
8,663,087 B2 * 3/2014 Kolar ..... A61H 9/0021 600/38
2005/0064383 A1 * 3/2005 Bashkin ..... G01N 15/1456 435/4
2010/0041944 A1 * 2/2010 Levy ..... A61F 5/41 600/38
2010/0069706 A1 * 3/2010 Rousere ..... A61D 19/021 600/33
2010/0174257 A1 * 7/2010 Matsuura ..... A61B 10/0058 604/347
2012/0052485 A1 * 3/2012 Shany ..... A01N 1/0263 435/5
2013/0253457 A1 * 9/2013 Shubin, Sr. ..... A61F 5/453 604/349
2015/0265386 A1 * 9/2015 Schmitt ..... A61D 19/021 604/349

* cited by examiner

SYSTEM FOR COLLECTING ANIMAL SEMEN AND METHOD FOR COLLECTING ANIMAL SEMEN USING SUCH A SYSTEM

The present invention concerns the general field of collecting animal semen, in particular bovine semen, and more particularly the systems for collecting that semen and to the methods for collecting that semen using such collecting systems. The invention also concerns such systems comprising cryoprotectant (or cryopreservative) extenders (or dilution media) for animal semen, in particular bovine semen.

Systems for collecting animal semen, in particular bovine semen, are already known which are formed by an artificial vagina to mount on the penis of the animal to stimulate it and a collector tube fastened to a cone of the artificial vagina to receive the animal semen.

Once received in the collector tube, the animal semen is analyzed in a specific room often referred to as a laboratory, next it is pre-diluted (first dilution) and then diluted (second dilution), before being preserved, for example cryogenically, in unitary packages called straws.

Generally a time of the order of a few minutes to ten minutes approximately may elapse between the end of the semen collection, the analysis of the pure semen and the first dilution.

This first dilution may be carried out by mixing the received semen with a predetermined extender. This may for example be a buffer solution comprising substances for preservation/protection of the membranes of the spermatozoa of the semen and/or antibiotics.

The preservation/protection substances are advantageous in particular in collecting of bovine semen since it is known that bovine semen plasma comprises certain proteins binding to the membranes of the spermatozoa just after the ejaculation of the animal, which promotes ("instantaneous") acrosomal reactions and which is therefore detrimental to the preservation of the spermatozoa.

For example, an extender is known comprising, in addition to a tris type buffer (tris standing for (tris(hydroxymethyl)aminomethane or tris(2-amino-2-(hydroxymethyl) propane-1,3-diol)/citric acid/fructose of which the composition is familiar to the person skilled in the art, low density lipoproteins (or LDL) extracted from egg yolk (D. Tainturier et al., "*Production et conservation de la semence animale*", RASPA Vol. 11, No. S, 2013).

Although these lipoproteins may constitute cryoprotectant molecules that are relatively effective relative to the solutions previously used, they have the drawback of not being able to be produced industrially. They nevertheless constitute desirable cryoprotectant molecules.

The invention concerns a system directed to improving the performance of the known systems for collecting animal semen, in particular bovine semen, in a simple, convenient and economic manner.

According to a first aspect, the invention is thus directed to a system for collecting animal semen, in particular bovine semen, comprising a container configured to be mounted on an end of an artificial vagina and having an internal space configured to receive said semen, wherein said container is furthermore configured to comprise, prior to receiving said semen, a first dilution extender of said semen and in that said system further comprises a collecting device configured to be at least partially inserted into said container and to be fastened to said artificial vagina, said collecting device being interposed between said artificial vagina and said container, said collecting device comprising a flow channel for said semen extending within said internal space of said container and a discharge aperture for said semen open to said internal space of said container; and said system is configured to prevent, at least for the most part, said first dilution extender from passing in said flow channel of said collecting device.

The collecting system according to the invention enables the animal semen to be placed directly and immediately in contact with the first dilution extender during the collection of the semen, prior to carrying out the analyses.

Furthermore, the collecting system according to the invention is configured for that placing in contact to be carried out without risk of the first dilution extender passing back (at least for the most part) to the artificial vagina where it would not have its function of first dilution of the semen.

The system according to the invention is thus advantageous in that it enables its user, often called an AI technician, to easily mount the artificial vagina together with that system on the penis of the animal, in a position in which the artificial vagina and thus the collecting system are inverted (head down); this being without risk of the first dilution extender coming out of the container.

The system according to the invention is furthermore advantageous to use when the collecting of bovine or animal semen may be particularly violent and inflict numerous jolts on the collecting system.

According to preferred, simple, convenient and economical features of the system according to the invention:

- said collecting device comprises a first lateral wall having a first portion of cylindrical general shape and configured for fitting by insertion to said end of said artificial vagina;
- said container has the form of a tube of cylindrical general shape and said collecting device comprises a first lateral wall having a second portion of cylindrical general shape and configured for fitting by insertion to said tube;
- said collecting device comprises a first lateral wall having a third portion extending in said internal space of said container and in which is provided at least one vent;
- said collecting device comprises a second lateral wall extending from said first lateral wall and being narrowed relative to that first lateral wall, and having a first portion of cylindrical general shape and a tip extending from said first portion, said tip and said first portion forming said flow channel of said collecting device;
- said tip has a frusto-conical general shape which narrows towards a free end of said collecting device and said discharge aperture is provided at that free end;
- said collecting device is made from a thermoplastic polymer, in particular polyoxymethylene, whereby said flow channel has an inside face having a surface tension which facilitates the flow of said semen;
- said discharge aperture has an inside diameter comprised between approximately 5 mm and approximately 15 mm;
- said system further comprises a diluting device for diluting said semen configured to be mounted on said container, instead of and in place of said collecting device after withdrawal of the latter from said container once the collecting has been carried out;
- said container has the form of a tube of cylindrical general shape and said diluting device has a general shape of a funnel having an end portion of cylindrical general shape and configured for fitting by insertion to said tube;

said diluting device comprises a lateral wall having an opposite end edge to said end portion, and a cover configured to be fastened to said end edge of said lateral wall;

said system further comprises a predetermined volume of said first dilution extender; and/or said system has a resting configuration, before collecting said semen, in which it is configured for said discharge aperture of said collecting device to be located facing and spaced approximately 5 mm to approximately 35 mm from said first dilution extender when the latter is located in said container.

According to other preferred, simple, convenient and economical features of the system according to the invention, said first dilution extender is constituted by a buffered saline solution containing liposomes, wherein:

the liposomes are present in the first dilution extender at a concentration of 10 g/L to 60 g/L the liposomes are present in the first dilution extender at a concentration of 30 g/L to 40 g/L;

the liposomes are formed by phosphatidylcholine in a ratio of 20% a 100% by weight;

the liposomes are formed by phosphatidylcholine in a ratio of 60% to 80% by weight; and/or the first dilution extender is constituted by a buffered saline solution containing low density lipoproteins (LDLs).

The liposomes are artificial vesicles (or capsules) formed by concentric lipid bilayers, enclosing an aqueous volume. They are obtained from amphiphilic lipids, and especially from phospholipids having a polarized "head" (hydrophilic) generally formed from a residue of glycerol-3 phosphate esterified by a polarized molecule, and two hydrophobic "tails" (which are constituted by the chains of two fatty acids).

Phosphatidylcholine (or lecithin or 1-oleyl-2-stearyl-phosphatidylcholine) is a phospholipid obtained from egg yolk according to a reproducible method. The method of obtaining liposomes is generally based on the extrusion with a mini-extruder such as that of the company Avanti Polar Lipids; but any other method known to the person skilled in the art may be used. The vesicles formed are spheroidal, generally of average size less than 200 nm in diameter.

The low density lipoproteins mainly comprise the following four lipids: sphingomyelin, le cholesterol, la 1-palmitoyl-2-docosahexaenoyl-sn-glycero-3-phosphocholine (16:0-22:6 PC; (CAS NO. 59403-54-2) and plasmalogen 1-(1Z-octadecyl)-2-docosahexaneoyl-sn-glycero-3-phosphocholine (P-PC).

According to a second aspect, the invention also relates to a method of collecting animal semen, in particular bovine semen, using a system for collecting animal semen as described above, comprising the steps of:

providing a container configured to be mounted on an end of an artificial vagina and having an internal space configured to receive said semen;

introducing a determined volume of a first dilution extender of said semen in said internal space of said container;

providing a collecting device comprising a flow channel and a discharge aperture for said semen;

inserting said collecting device at least partially into said container such that said flow channel extends in said internal space of said container and said discharge aperture is open to said internal space of said container;

providing an artificial vagina; and fastening said collecting device to said artificial vagina so as to interpose said collecting device between said artificial vagina and said container; said system being configured to prevent at least for the most part said first dilution extender from passing in said flow channel of said collecting device during the collection of semen.

According to preferred, simple, convenient and economical features of the method according to the invention, it comprises the steps of rinsing said collecting device after collecting said semen then removing the collecting device from said container; and/or it comprises the steps of providing a diluting device for diluting said semen then of mounting said diluting device on said container, instead of and in place of said collecting device after withdrawal of the latter from said container once the collecting has been carried out; and/or it comprises the steps of introducing a determined volume of a second dilution extender of said semen into said internal space of said container and into an internal space of said diluting device, of fastening a cover of said diluting device to an end edge of the latter then of performing a second dilution of said semen.

The disclosure of the invention will now be continued with the description of embodiments, given below by way of illustrative and non-limiting examples, with reference to the accompanying drawings, in which:

FIG. 1 is a partial diagram in cross-section of a system for collecting animal semen, in particular bovine semen, in a resting configuration, in which it comprises an artificial vagina, a device for collecting semen fastened to a cone of the artificial vagina and a container comprising a determined volume of a first dilution extender and which is mounted on the collecting device, the latter being interposed between the cone of the artificial vagina and the container;

Figure 3:
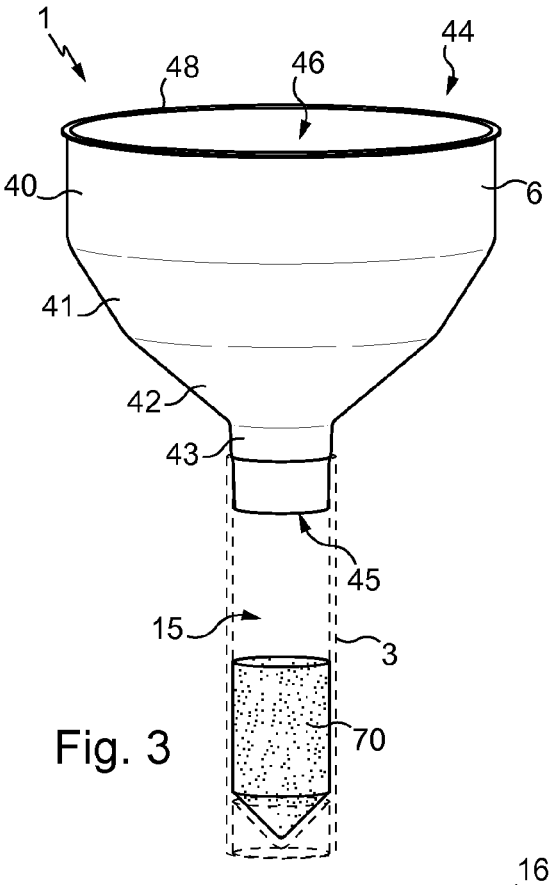
FIG. 3 is a diagram partially in perspective and partially in cross-section, of the system of FIG. 1, here in a dilution configuration in which it comprises a diluting device mounted on the container, instead of and in place of the collecting device, after removing the latter from the container.
Figure 4:
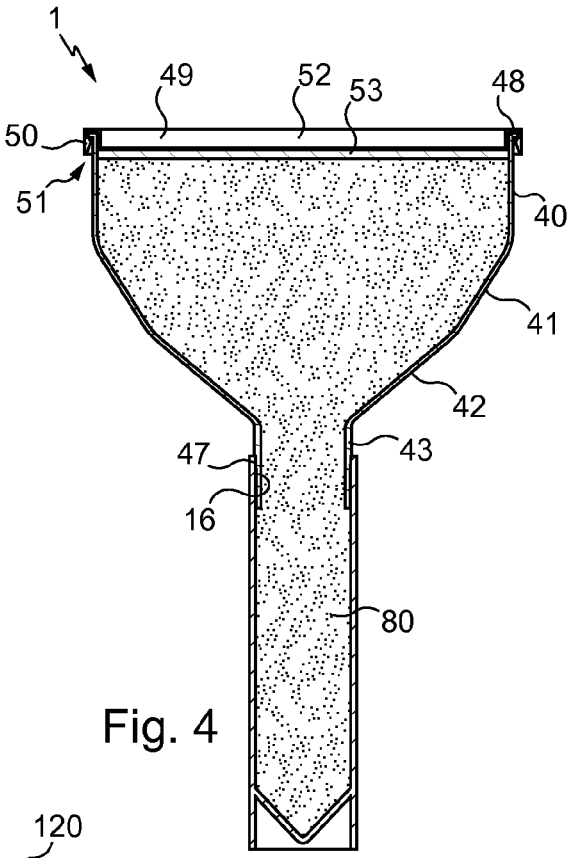
FIG. 4 is a diagram in cross-section of the system illustrated in FIG. 3, after introduction into the container and into the diluting device of a determined volume of a second dilution extender.
Figure 5:
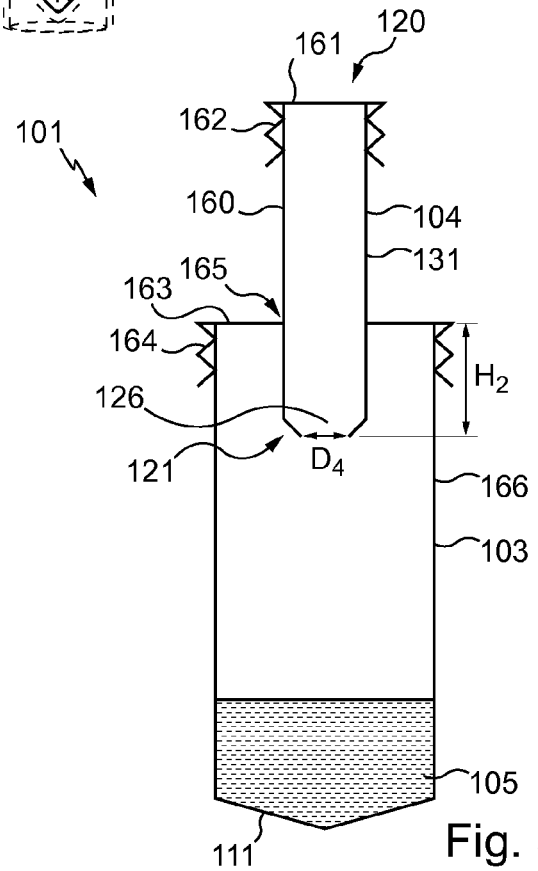
Figure 6:
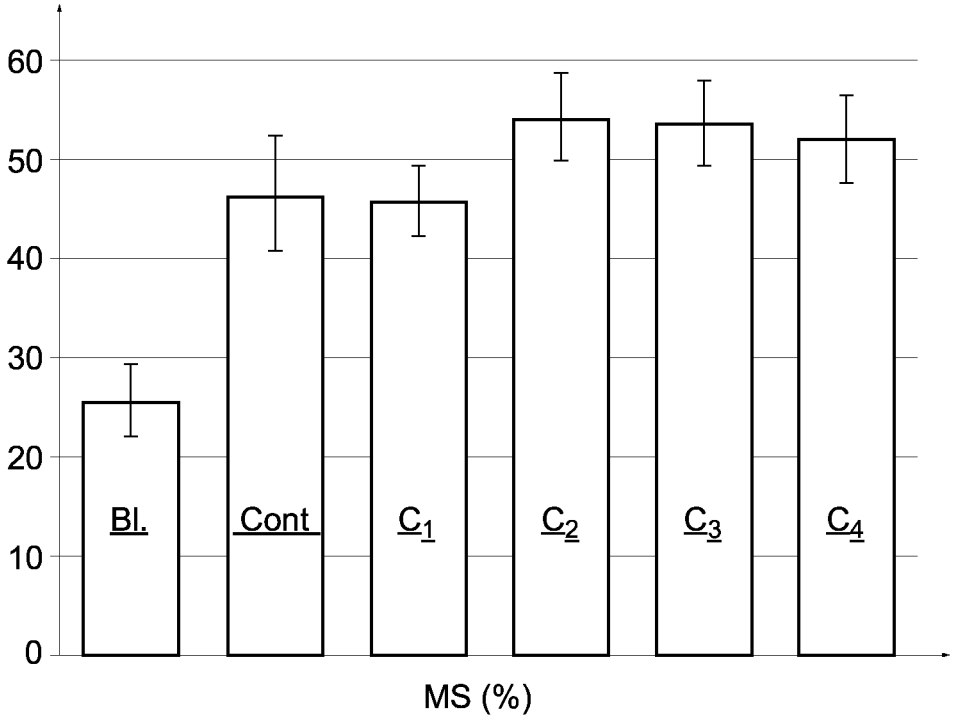
Figure 7:
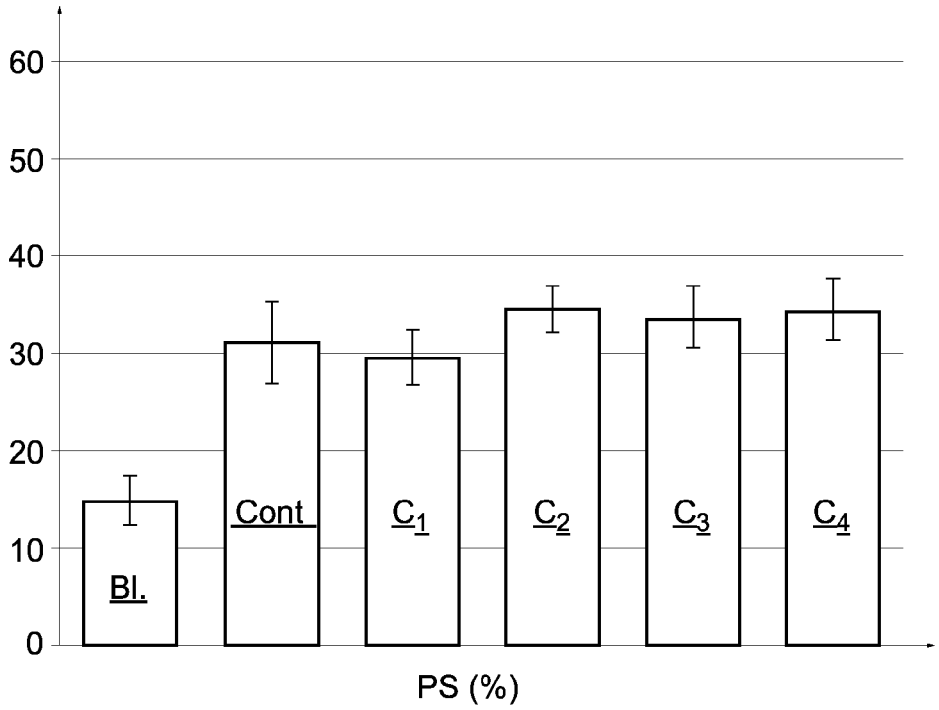
Figure 8:
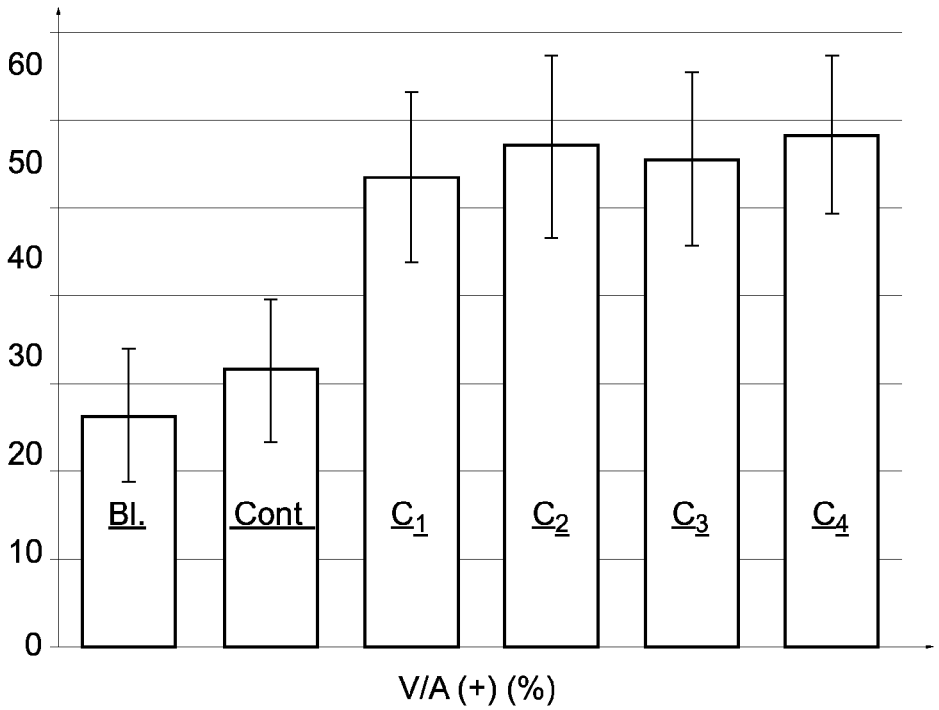

FIG. 5 is a partial diagram in cross-section of a variant embodiment of the collecting system illustrated in FIGS. 1 to 4; and FIGS. 6 to 8 illustrate the examples and respectively indicate the percentages of mobile spermatozoa (MS), the percentages of progressive spermatozoa (PS) and the percentages of viable spermatozoa with acrosomes intact (+) (V/A (+)), in cases of use of a first dilution extender, which is cryoprotectant, either without any cryoprotectant molecule "BI" ("Blank"), or with LDL cryoprotectant molecules "Cont" ("Control C1"), or with liposomal cryoprotectant molecules at various concentrations (C1, C2, C3 and C4).

Figure 1:
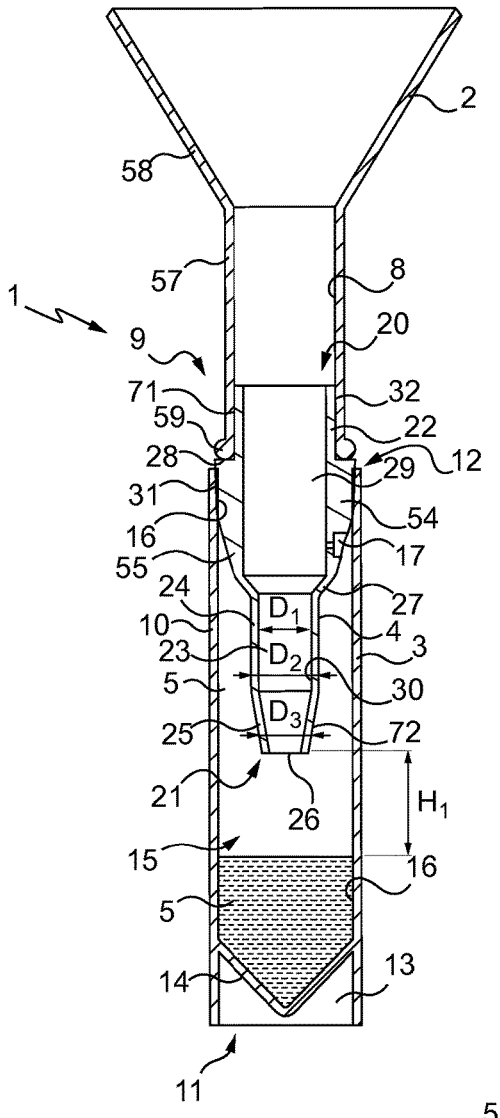

FIG. 1 illustrates a system for collecting animal semen 1, here in a resting configuration. Here this is a system 1 for collecting bovine semen.

This system 1 comprises a container 3 configured to receive bovine semen, as well as a collecting device 4 fastened both to the container 3 and to a cone of an artificial vagina 2 configured to be mounted on the penis of the animal (not shown) to stimulate it.

The cone of the artificial vagina 2, which is here only partially represented, here is of substantially frusto-conical shape of which the narrowest portion extends towards an end 9 of that cone of an artificial vagina 2.

The container 3 is a tube here of cylindrical general shape, having a lateral wall 10 extending between an end 11 closed by a bottom wall 14 and an open end 12, which is an opposite end to the closed end 11.

The lateral wall 10 of the tube 3 has an inside face 16 defining a space 15 internal to the tube 3, that internal space 15 being provided to receive, prior to collection, a predetermined first dilution extender 5, then during the collection, to receive the animal semen.

The bottom wall 14 provided in the internal space 15 is V-shaped, in the manner of a centrifugation tube and the tube 3 further comprises a recess 13 formed between the closed end 11 and the bottom wall 14.

The tube 3 is here made from plastics material molded in one piece and its internal space 15 here has a volume of approximately 30 mL, and more generally a volume of approximately 20 mL to 200 mL.

The collecting device 4 extends substantially longitudinally between a first end 20 and a second end 21 which is an opposite end to the first end 20.

The collecting device 4 comprises a first lateral wall 71 of substantially cylindrical general shape, and a second lateral wall 72 extending onwards from the first lateral wall 71 and also being of substantially cylindrical general shape.

The first lateral wall 71 has a recess 29 forming an internal space and the second lateral wall 72 forms a flow channel 23 for the semen, which channel 23 is narrowed relative to the internal space of the first lateral wall 71.

The recess 29 is in fluidic communication with the flow channel 23.

The first lateral wall 71 has, at the first end 20, a first portion 22 of cylindrical general shape and configured for fitting to the end 9 of the cone of the artificial vagina 2.

The first lateral wall 71 has a second portion 54 of cylindrical general shape, extending from the first portion 22, and configured for fitting by insertion to the lateral wall 10 of the tube 3.

The second portion 54 is connected to the first portion 22 by a shoulder 28 formed in the first lateral wall 71.

The shoulder 28 is configured in order for the second portion 54 to have a greater outside diameter than the outside diameter of the first portion 22.

The first lateral wall 71 has a third portion 55 extending in said internal space 15 of the container 3, from the second portion 54.

This third portion 55 has an outside face of frusto-conical general shape and the collecting device 4 is provided with a vent 17 formed in that third portion 55.

The vent 17 comprises a first chamber having a first inside diameter and open to the outside of the first lateral wall 71 of the collecting device 4, as well as a second chamber having a second inside diameter, much less than the first inside diameter of the first chamber, and open to the recess 29 formed in the first lateral wall 71 of the collecting device 4.

The vent 17 is thus configured to create fluidic communication for the air, which communication is reversible but facilitated from the second chamber to the first chamber on account of the respective inside diameters (in other words, facilitated from the recess 29 of the collecting device 4 to the internal space 15 of the tube 3).

The vent 17 is also configured to prevent fluidic communication for the animal semen, in particular from the first chamber to the second chamber (in other words prevented from the internal space 15 of the tube 3 to the recess 29 of the collecting device 4).

The second lateral wall 72 has a first portion 24 of cylindrical general shape, connected to the third portion 55 of the first lateral wall 71 via an intermediate portion 27, as well as a tip 25 extending from the first portion 24 to the second end 21.

The second portion 24 is thus interposed between the intermediate portion 27 and the tip 25.

The tip 25 is frusto-conical with its narrowest portion located at the end 21, where a discharge aperture 26 for the semen is moreover formed.

The second portion 24 and the frusto-conical tip form the flow channel 23 for the animal semen.

The intermediate portion 27 is configured to form an inside shoulder in the recess 29.

The collecting device 4 is made from plastics material molded in a single piece, and in particular here from a thermoplastic polymer, in particular polyacetal or polyoxymethylene (POM).

More generally, the collecting device 4 is configured such that the flow channel 23 has an inside face 30 having a surface tension facilitating the flow of the animal semen.

The first portion 24 has an outside diameter $D_1$ here approximately equal to 11 mm and an inside diameter $D_2$ here approximately equal to 8.6 mm.

Figure 2:
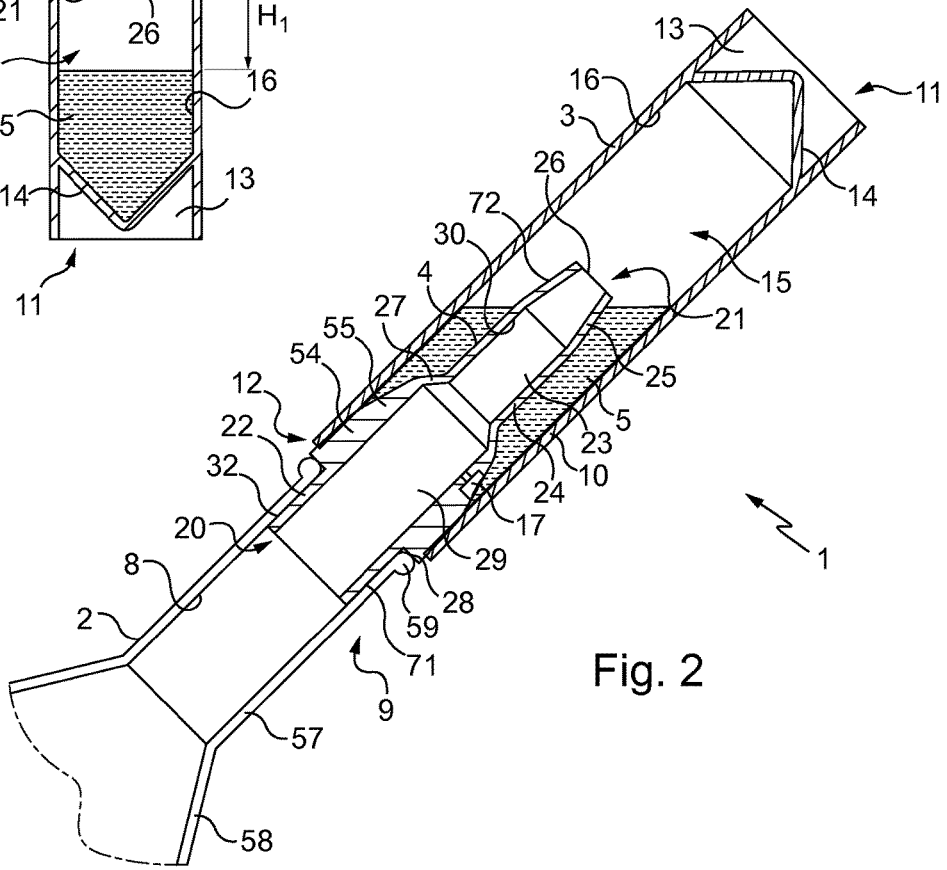
FIG. 2 is a similar view to that of FIG. 1, here in a mounting configuration of the system for mounting on the penis of the animal, for collecting the semen.

The frusto-conical tip 25 has a minimum inside diameter $D_3$ here approximately equal to 5 mm. This minimum inside diameter $D_3$ represents the smallest passage for the animal semen in the flow channel 23, at the location of the discharge aperture 26 for that semen (FIG. 2).

More generally, the outside diameter $D_1$ is comprised between approximately 5 mm and approximately 17 mm, the inside diameter $D_2$ is comprised between approximately 8 mm and approximately 20 mm and the minimum inside diameter $D_3$ is comprised between approximately 5 mm and approximately 15 mm.

The second cylindrical portion 54 of the first lateral wall 71 of the collecting device 4 is partially inserted, by force, into the tube 3 such that the flow channel 23 of that collecting device 4 extends in the internal space 15 of the tube 3 towards the bottom wall 14 of the latter.

More specifically, that second cylindrical portion 54 has an outside face 31 which comes into contact with the inside face 16 of the lateral wall 10 of the tube 3.

The collecting device 4 is fitted by insertion into the tube 3 such that the frusto-conical tip 25 of that collecting device 4 and more specifically its discharge aperture 26, is located facing the first dilution extender 5 situated at the bottom of the tube 3, when the system 1 is in its resting configuration (FIG. 1).

The tube 3 and the collecting device 4 are configured for the discharge aperture 26 and the upper level of the first dilution extender 5 to be separated by a distance denoted $H_1$, here approximately equal to 4.7 mm, when the assembly formed by the collecting device 4 and the tube 3 are situated in vertical position. More generally, the distance $H_1$ is comprised between approximately 2 mm and approximately 35 mm.

The cone of the artificial vagina 2 has a frusto-conical portion 58 and a cylindrical portion 57 extending from the frusto-conical portion 58, to the end 9 of the cone of the artificial vagina 2.

At this end 9, the cylindrical portion 57 is provided with a free edge 59 in the form of a bead.

At this end 9, the cylindrical portion 57 is force fitted by partial insertion, to the first portion 22 of the first lateral wall 71 of the collecting device 4, at the location of its first end 22, the free edge 59 in the form of a bead coming to bear against the shoulder 28 formed on that first lateral wall 71.

Thus the collecting system 1, which is fastened via its collecting device 4 to the cone of the artificial vagina 2, is situated extending onwards from the latter and has a general inclination similar to that of the artificial vagina.

When the AI technician inserts the penis of the animal into the artificial vagina 2, the system 1 is disposed with an inclination for example of approximately 10 degrees to approximately 30 degrees above a horizontal plane (head down or in other words the discharge aperture 26 of the collecting device 4 up). This at least substantially inverted position of the system 1 may be maintained until ejaculation of the animal.

The arrangement of the collecting device 4 and of the tube 3 containing the first dilution extender 5 thus advantageously makes it possible, prior to the collection on mounting the artificial vagina 2 and the system 1 on the penis of the animal, where the system may be inverted (head down), and also during the collection, to retain the first dilution extender 5 in the tube 3 (FIG. 2).

More specifically, the collecting device 4 and the tube 3 containing the first dilution extender 5, are configured to prevent, at least for the most part, that first dilution extender 5 from passing in the flow channel 23 of the collecting device 4 at the time of mounting and during the collection of the animal semen.

Even in the case of collecting bovine semen, in which it is known that the animal may be particularly violent and inflict numerous jolts on the artificial vagina 2 and therefore on the collecting system 1, the configuration of the tube 3 and of the collecting device 4, in particular the first portion 24 and the frusto-conical tip 25 of its second lateral wall 72, prevents at least for the most part the first dilution extender 5 which is located in the internal space 15 of the tube 3, from passing into the flow channel 23 to the cone of the artificial vagina 2.

Next, the system 1 changes position until it has an inclination of approximately 10 degrees to approximately 30 degrees below the horizontal plane at the end of the collection.

When the animal descends from a teaser (also called dummy), the animal semen passes in the flow channel 23 of the collecting device 4 by gravity until it leaves that channel 23 by the discharge aperture 26 to immediately enter into contact with the first dilution extender 5.

This arrangement of the collecting device 4 and of the tube 3 containing the first dilution extender 5 thus also, advantageously, makes it possible, just after collecting the semen which discharges by gravity from the flow channel 23 by the discharge aperture 26, to place that semen immediately in contact with the first dilution extender 5.

Another configuration of the collecting system 1 will now be described with reference to FIGS. 3 and 4. In FIGS. 3 and 4 this is a second dilution configuration for the collected animal semen, of the collecting system 1.

In this second dilution configuration, the collecting device 4 is withdrawn from the tube 3.

The collecting system 1 then comprises, instead of and in place of the collecting device 4, a diluting device 6 for the animal semen with a general shape of a funnel having a first open end 45 turned towards the bottom of the tube 3 and a second open end 44 which is an opposite end to the first open end 45.

This diluting device 6 is configured to be mounted on the container 3 after withdrawal of the latter from the collecting device 4 once animal semen collection has been carried out.

It should be noted that in the tube 3 there is then present a so-called pre-dilution mixture of animal semen, denoted 70, composed of the harvested semen and of the pre-dilution extender 5. Here, this pre-dilution semen mixture 70 has a volume comprised between approximately 5 mL and approximately 15 mL for an initial volume of the first dilution extender 5 comprised here between approximately 2.5 mL and approximately 6 mL.

More generally, the initial volume of the first dilution extender 5 may be comprised between approximately 2 mL and approximately 60 mL such that the volume of the pre-dilution semen mixture 70 may be comprised between approximately 4 mL and approximately 120 mL.

It should be noted that the initial volume of the first dilution extender 5, also referred to as predilution extender, is preferably substantially similar to the volume of semen collected or to collect. For example, according to average volumes observed, for adult bulls, the volume of such a mixture may be approximately 6 mL whereas for young bulls, it may be only approximately 3 mL. These volume values also depend in particular on the age of the animals and on the frequency of collection.

Of course, these values also depend on the animal from which it is wished to collect the semen and possibly on the tube 3, of the collecting device 4 fastened to the tube 3 and on the cone of the artificial vagina 2 fastened to the collecting device 4. Thus, these values may for example vary from a few milliliters for the bovine species depending on the young genomic bulls or service bulls. These variations may be greater for other species.

The funnel-shaped diluting device 6 comprises a lateral wall defining an internal space 44 of the diluting device 6 and having a cylindrical first portion 40 at the location of its second open end 44, a substantially frusto-conical second portion 41 and which extends from the first cylindrical portion 40 towards the first open end 45, a third portion 42 also substantially frusto-conical and which extends from the second frusto-conical portion 41 towards the first open end 45, as well as a substantially cylindrical end portion 43 which extends from the third frusto-conical portion 42 to the first open end 45.

The arrangement of the different portions of the diluting device 6 makes it possible to optimize its volume relative to its height, as well as the flow of the fluids which it is configured to receive.

The end portion 43 is configured for fluid-tight fitting by insertion into the lateral wall 10 of the tube 3 at the location of its open end 12.

More specifically, that end portion 43 has an outside face 47 which is configured to come into contact with the inside face 16 of the lateral wall 10 of the tube 3.

The first cylindrical portion 40 of the diluting device 6 here has an inside diameter considerably greater than that of the end portion 43 which is situated remotely from the first cylindrical portion 40.

The lateral wall of the diluting device 6 further comprises, at the location of its second open end 44 and thus remote from its end portion 43, an end edge 48 linked to the first cylindrical portion 40.

This end edge 48 is configured to form a shoulder projecting from the lateral wall of the diluting device 6.

The diluting device 6 further comprises a cover 49 configured to be fastened to the end edge 48 of the lateral wall.

The cover 49 has a circular shape so as to close the opening formed in the diluting device 6 at its second open end 44.

The cover 49 has a recess 52 at the bottom of which is formed a fluid-tight wall 53 which is disposed in an internal space 46 of the diluting device 6 when the cover 49 is fastened thereon, to provide sealing between the cover 49 and that diluting device 6.

The cover 49 further comprises circular rim 50 configured for snap engagement on the end edge 48 of the lateral wall of the diluting device 6.

The circular rim 50 of the cover 49 is configured to leave a space between the latter and an outside face of the lateral wall of the diluting device 6, under the end edge 48, to allow the removal of the cover 49 from the lateral wall.

The lateral wall and the cover of the diluting device 6 are here produced from plastics material.

It should be noted that the collecting system 1 formed by the tube 3 and the diluting device 6 fitted by insertion on that tube 3, as illustrated in FIGS. 3 and 4, has a volume here equal to approximately 300 mL. More generally the collecting system 1 has a volume comprised between approximately 100 mL and approximately 1000 mL.

In FIG. 3, the collecting system 1 is shown before the second dilution of the animal semen and more specifically of the mixture 70 whereas in FIG. 4, a diluted mixture of the animal semen 80 fills the volume of the collecting system 1 illustrated.

It will be noted that once the animal semen has been correctly diluted, it is possible to directly take off from the collecting system 1 illustrated in FIG. 4 a plurality of predetermined volumes of the diluted mixture 80, for the filling of straws (not illustrated), for the purpose of the preservation of that diluted mixture 80, for example by cryopreservation of the straws.

A description will now be made of the method of collecting animal semen, in particular bovine semen, using the collecting system 1 as described above. The animal semen collecting method comprises the step of providing the tube 3 as described above then of introducing into the internal space 15 thereof a determined volume of the first dilution extender 5.

For example, this determined volume of the first dilution extender 5 may be situated in the interval [2.5 mL; 6 mL].

It should be noted that this first dilution extender 5 may comprise a buffer solution composed for example of substances for preservation/protection of the membranes of the spermatozoa of the animal semen and/or antibiotics.

The animal semen collecting method further comprises the step of providing a collecting device 4 as described above and of inserting the latter at least partially into the tube 3 such that the flow channel 23 extends inside the internal space 15 of the tube 3 and the discharge aperture 26 opens into that internal space 15.

Here, the collecting device 4 is fitted by insertion into the tube 3.

Once the collecting device 4 has been fitted by insertion into the tube 3, it will be noted, as indicated previously, that the discharge aperture 26 is located facing the first dilution extender 5 and at a determined distance.

The animal semen collecting method further comprises the step of providing an artificial vagina 2 such as described above and of fastening the collecting device 4 on the cone of the artificial vagina 2 so as to interpose that collecting device 4 between the cone of the artificial vagina 2 and the tube 3.

It will be noted, as indicated previously, that the collecting system 1 then extends in line with the artificial vagina 2 and is therefore inclined relative to a horizontal plane (above or below, see above).

Furthermore, the collecting system 1 and in particular the collecting device 4 and the tube 3, are configured to prevent at least for the most part the first dilution extender 5 from passing in the flow channel of the collecting device 4 during the collection of the animal semen.

The method of collecting animal semen further comprises, once the ejaculation of the animal has ended and the semen has flowed into the tube 3 and thus into contact with the pre-dilution extender 5, the step of withdrawing the collecting system 1 from the cone of the artificial vagina 2, by removing the cylindrical portion 57 of the cone of the first portion 22 of the first lateral wall 71 of the collecting device 4.

The collecting method next comprises the step of rinsing the collecting device 4 after collecting the semen, via for example a second dilution extender, then of removing that collecting device 4 from the tube 3.

The animal semen collecting method also comprises the steps of providing a device 6 for diluting the semen as described above then of mounting that diluting device 6 on the tube 3, here by force fitting by insertion, instead of and in place of the collecting device 4 after removal of the latter from the tube 3 once the collection has been carried out.

The semen collecting method comprises the steps of introducing a determined volume of a second dilution extender of the semen into the internal space 15 of the tube 3 and into the internal space 46 of the diluting device 6, of fastening the cover 49 onto the end rim 48 of the diluting device 6 then of performing a second dilution of the animal semen and more particularly a dilution of the pre-deleted semen mixture 70 in order to obtain the diluted mixture 80 of that semen.

The method may furthermore comprise the steps of taking off a plurality of determined volumes from the mixture 80, of filling straws each with a determined volume of that mixture 80 and of cryopreservation of those filled straws for the purpose of preserving those volumes of mixture 80.

It should be noted that the immediate first dilution of the semen with the first dilution extender 5 directly in the tube 3, the rinsing of the collecting device 4 mounted on the tube 3 and the second dilution by virtue of the diluting device 6 mounted on the tube 3 instead of and in place of the collecting device 4 after its removal from the tube 3 when the semen collection has been carried out, makes it possible both to simplify the animal semen collecting method by minimizing the number of steps and to considerably limit the volumetric losses of animal semen, pre-diluted mixture of that semen and diluted mixture of that semen, in comparison with the semen collection methods of the prior art in which a plurality of pouring steps are necessary leading to losses in volume.

The collecting system 1, while being particularly simple, convenient and economical, thus makes the collecting method itself particularly simple, convenient and economical and enables the filling of a higher number of straws for the purpose of the preservation of the collected animal semen.

A variant embodiment of the collecting system will now be described with reference to FIG. 5.

Generally, for similar parts the same references have been used, to which the number 100 has been added.

The collecting system 101 is illustrated here in the same configuration as the collecting system 1 of FIG. 2.

The tube 103 here has a higher capacity than the tube 3 illustrated in FIGS. 1 to 4. This tube 103 here has for example a volume approximately equal to 50 mL.

This tube 103 furthermore here has a determined volume of a first dilution extender 105, comprised for example between approximately 3 mL and approximately 15 mL.

This first dilution extender 105 is located at the bottom of the tube, against a V-shaped wall, at the closed end 111 of the tube 103.

The tube 103 further comprises a cover 163 having through it an aperture 165, here central, and the cover 163 has a circular folded back edge 164 which comes to be applied to an outside face 166 of the lateral wall of the tube 103.

The collecting device 104 of the collecting system 101 is of cylindrical general shape, similar to that of the tube 103, having a lateral wall 160 extending between a first end 120 and a second end 121 which is an opposite end to the first end 120.

The collecting device 104 here has a volume of approximately 15 mL.

The collecting device 104 is furthermore provided with a cover 161 mounted at the location of its first end 120 and having a circular folded back edge 162 provided to come to be applied to an outside face 131 of the lateral wall 160.

The collecting device 104 is configured to be inserted into the internal space of the tube 103, the second end 121 of the collecting device 104 first, through the aperture 165 formed in the cover 163 of the tube 103.

It should be noted that the opening 165 here has a diameter approximately equal to 15 mm and the collecting device 104 is inserted into the tube 103 by a determined length denoted here $H_2$, comprised between approximately 3 mm and approximately 10 mm.

The collecting device 104 furthermore has a discharge opening 126 formed in a substantially frusto-conical bottom wall of that collecting device 104.

The discharge aperture 126 here has a diameter comprised between approximately 3 mm and 10 mm.

Of course, this collecting device 104 is configured to be fastened to the cone of an artificial vagina.

For this, the cover 161 may be withdrawn from the collecting device 104 or the cover 161 may comprise a passage aperture for the passage of the end of the cone of the artificial vagina and/or members for mounting on the latter.

A description will now be given of the examples of first dilution extenders 5, that are cryopreservative, of which the behavior in the presence of bovine semen is illustrated by FIGS. 6, 7 and 8. Such a dilution extender has a volume comprised between approximately 2.5 mL and approximately 6 mL.

The buffered saline solution (Blank or "Bl") comprised tris(2-amino-2-(hydroxymethyl) propane-1,3-diol (173.0 mMol), citric acid monohydrate (70.0 mMol), fructose (56.0 mMol) and glycerol (6.4% vol/vol). The pH was adjusted to 6.2 and the osmolarity was approximately 1300.0 mOsm.

The cryoprotectant extender of low density lipoproteins (LDL) was extracted from egg yolk according to the protocol described by Moussa et al. (Theriogenology 57(6): 1695-1706). After extraction, the quantity obtained from that LDL sample was diluted in the buffered saline solution (100 mL), which gave the "control C1" solution: "Cont". This solution, which is in accordance with the invention, was compared with the solutions according to the invention comprising liposomes. The proteins, quantified using the BC Assay (using a Pierce micro-kit from the company Thermoscientific), were present in the LDL sample in an amount of 8 g/L.

The liposomes were produced from a phospholipid egg extract, in the buffered saline solution, by extrusion using a mini-extruder from the company Avanti Polar Lipids. They were composed of 73% phosphatidylcholine, 11% phosphadiethanolamine and various compounds in lesser quantities (neutral lipids, triglycerides and sphingomyelin). The extracts were hydrated in the buffered saline solution for one night at lipid concentrations of respectively 10 g/L for the solution C1; 20 g/L for the solution C2; 40 g/L for the C3 solution; and 60 g/L for the C4 solution. The solutions were then treated with ultrasound for 15 minutes (with an Elmasonic S 30 H apparatus from the company Elma, at a power of 275 W). At the end, the dispersions were extruded (20 passages per membrane of 100 nm).

Characterization of the Prim'Hosltein bovine semen was carried out by protein quantification in advance. The semen was immediately centrifuged twice at 10 000×g to recover the semen plasma from the supernacent liquid. The quantity of protein in that bovine semen sample was 88.5 mg/mL. It was quantified by BC Assay (using a Pierce micro-kit from the company Thermoscientific).

The results of the immediate placing in contact between each of the cryoprotectant extenders and the bovine semen, at half-dilution (i.e. 50%-50% in volume) are illustrated by FIGS. 6, 7 and 8. Each test was reproduced in relation to 10 ejaculates (4 tests; 4 bulls; 10 ejaculates with a volume of 4 to 6 ml), which enabled the measurement accuracy to be indicated on the Figures.

Spermatozoa motility analyses were conducted on a system known as CASA (standing for "computer assisted semen analysis") for example with an apparatus known under the name IVOS designed and developed by the company Hamilton Thorne. Analyses were carried out for viable spermatozoa with acrosomal integrity using cytometry, for example with an apparatus known under the name EasyCyte designed and developed by the applicant company and the company Millipore.

FIG. 6 is a schematic diagram illustrating the percentage of motile spermatozoa (MS) obtained after the placing in contact of each of the solutions with the semen (the 100% level corresponding to the total population of spermatozoa).

FIG. 7 is a schematic diagram illustrating the percentage of progressively motile spermatozoa (PS) obtained after the placing in contact of each of the solutions with the semen.

FIG. 8 is a schematic diagram illustrating the percentage of viable spermatozoa with acrosomal integrity (V/A (+)) obtained after the placing in contact of each of the solutions with the semen.

It is found that the results are better in the case of a cryoprotectant first dilution extender containing LDL or liposome cryoprotectant molecules ("Cont", C1, C2, C3 or C4) than in an extender not comprising such cryoprotectant molecules ("Bl"). Furthermore, the results obtained for motility and viability of the spermatozoa are substantially better above a certain liposome concentration with the solutions C2, C3 and C4 comprising liposomes than with solution C1 or control solution C1.

Such liposome solutions are thus particularly preferred according to the invention, but any cryoprotectant extender, in particular comprising LDLs, may be used in the system according to the invention.

In a variant not illustrated of the collecting device, the latter comprises a flow channel formed for example by a cylindrical portion in which are formed low walls to form a chicane system in the flow channel; thereby preventing the first dilution extender from passing into the flow channel.

In another variant not illustrated of the collecting device, the latter has a flow channel at the end of which is formed a valve enabling the passage of the animal semen to the internal space of the container and preventing at least for the most part the passing of the first dilution extender into the flow channel of the collecting device.

In a variant not illustrated of the collecting system, the container has a rectangular shape and the collecting device is formed by a plate at least partly inserted into the container and extending through the latter; that plate being provided with at least one aperture for the discharge of the semen into the internal space of the container when that semen passes onto the plate.

In variants that are not illustrated:

- the container is not formed by a tube with a V-shaped bottom as illustrated in FIGS. 1 to 5 but instead has a flat-bottomed tube shape or a bowl shape;
- the container is not of plastics material but is instead formed of glass;
- the collecting device is not fitted by insertion into the container but instead around the container, or the collecting device and the container each have cooperation members enabling them to be fastened to each other;
- the collecting device does not have the shape illustrated in FIGS. 1 and 2 but rather a frusto-conical general shape between its two ends;
- the collecting device is not formed from polyoxymethylene but more generally from a thermoplastic polymer and still more generally from plastic;
- the collecting device does not comprise a portion around which the cone of the artificial vagina may be fitted, but external fastening members instead provided to fasten around the artificial vagina, or a recess in which the cone of the artificial vagina comes to be fitted by insertion;
- the tube and the collecting device do not have the volumes referred to above but each have greater or smaller volumes;
- the diluting device does not have a funnel shape but rather that of a flat-bottomed vase;
- the cover of the diluting device is hinged to its lateral wall rather than being removable;
- the diluting device is not fitted by insertion into the tube but instead around the tube or the diluting device and the tube each have complementary fastening members for fastening the diluting device to the tube;
- the diluting device and the tube are configured to have different capacities from those referred to above, for example higher or lower capacities; and/or
- the collecting system and more particularly the container may initially comprise a determined volume of the first dilution extender that is different from the volumes referred to above, for example a higher or lower volume.

It should be noted more generally that the invention is not limited to the examples described and represented.

The invention claimed is:

1. A system for collecting animal semen, comprising a container which is mounted on an end of an artificial vagina and which has an internal space for receiving both said animal semen and, prior to receiving said animal semen, a first dilution extender for diluting said animal semen; and said system further comprises a collecting device at least partially inserted into said container and fastened to said artificial vagina, said collecting device being thus interposed between said artificial vagina and said container, said collecting device comprising a flow channel for said animal semen extending within said internal space of said container and a discharge aperture for said animal semen open to said internal space of said container; and said system is configured to prevent said first dilution extender from passing into said flow channel of said collecting device.

2. The system according to claim 1, wherein said collecting device comprises a first lateral wall having a first portion of cylindrical general shape and configured for fitting by insertion to said end of said artificial vagina.

3. The system according to claim 1, wherein said container has the form of a tube of cylindrical general shape and said collecting device comprises a first lateral wall having a second portion of cylindrical general shape and configured for fitting by insertion to said tube.

4. The system according to claim 1, wherein said collecting device comprises a first lateral wall having a third portion extending in said internal space of said container and in which is provided at least one vent.

5. The system according to claim 2, wherein said collecting device comprises a second lateral wall extending from said first lateral wall and being narrowed relative to that first lateral wall, and having a first portion of cylindrical general shape and a tip extending from said first portion, said tip and said first portion forming said flow channel of said collecting device.

6. The system according to claim 5, wherein said tip has a frusto-conical general shape which narrows towards a free end of said collecting device and said discharge aperture is provided at that free end.

7. The system according to claim 1, wherein said collecting device comprises a thermoplastic polymer; whereby said flow channel has an inside face having a surface tension for facilitating the flow of said animal semen.

8. The system according to claim 1, wherein said discharge aperture has an inside diameter comprised between approximately 5 mm and approximately 15 mm.

9. The system according to claim 1, wherein it further comprises a diluting device for diluting said animal semen and which is mounted on said container, instead of and in place of said collecting device after withdrawal of the latter from said container once the collecting has been carried out.

10. The system according to claim 9, wherein said container has the form of a tube of cylindrical general shape and said diluting device has a general shape of a funnel having an end portion of cylindrical general shape and configured for fitting by insertion to said tube.

11. The system according to claim 9, wherein said diluting device comprises a lateral wall having an opposite end edge to said end portion, and a cover configured to be fastened to said end edge of said lateral wall.

12. The system according to claim 1, wherein it further comprises a predetermined volume of said first dilution extender.

13. The system according to claim 12, wherein it has a resting configuration, before collecting said animal semen, in which it is configured for said discharge aperture of said collecting device to be located facing and spaced approximately 5 mm to approximately 35 mm from said first dilution extender when the latter is located in said container.

14. The system according to claim 12, wherein said first dilution extender comprises a buffered saline solution containing liposomes.

15. The system according to claim 14, wherein the first dilution extender comprises the liposomes at a concentration of 10 g/L to 60 g/L.

16. The system according to claim 14, wherein the first dilution extender comprises the liposomes at a concentration of 30 g/L to 40 g/L.

17. The system according to claim 14, wherein the liposomes comprise phosphatidylcholine in a ratio of 20% to 100% by weight.

18. The system according to claim 14, wherein the liposomes comprise phosphatidylcholine in a ratio of 60% to 80% by weight.

19. The system according to claim 12, wherein said first dilution extender is constituted by a buffered saline solution containing low density lipoproteins (LDLs).

20. A method of collecting animal semen using a system for collecting animal semen according to claim 1, comprising the steps of:

providing the system for collecting animal semen according to claim 1 comprising the container mounted on the end of the artificial vagina and having the internal space for receiving said animal semen and further comprising the collecting device comprising the flow channel and the discharge aperture for said animal semen and further comprising the artificial vagina;

introducing a determined volume of the first dilution extender for diluting said animal semen in said internal space of said container;

inserting said collecting device at least partially into said container such that said flow channel extends in said internal space of said container and said discharge aperture is open to said internal space of said container;

fastening said collecting device to said artificial vagina so as to interpose said collecting device between said artificial vagina and said containers; said system being configured to prevent said first dilution extender from passing into said flow channel of said collecting device during the collection of animal semen.

21. The method according to claim 20, comprising the steps of rinsing said collecting device after collecting said animal semen then removing the collecting device from said container.

22. The method according to claim 21, comprising the steps of providing a diluting device for diluting said animal semen then of mounting said diluting device on said container, instead of and in place of said collecting device after withdrawal of the collecting device from said container once the collecting has been carried out.

23. The method according to claim 22, comprising the steps of introducing a determined volume of a second dilution extender of said animal semen into said internal space of said container and into an internal space of said diluting device, of fastening a cover of said diluting device to an end edge of the latter then of performing a second dilution of said animal semen.

24. The system according to claim 1, wherein the animal semen is bovine semen.

25. The system according to claim 7, wherein the thermoplastic polymer is polyoxymethylene.

* * * * *